US005296713A

United States Patent [19]

Tanaka

[11] Patent Number: 5,296,713

[45] Date of Patent: Mar. 22, 1994

[54] ION SOURCE DEVICE

[75] Inventor: Hisato Tanaka, Nirasaki, Japan

[73] Assignee: Tokyo Electron Limited, Tokyo, Japan

[21] Appl. No.: 7,786

[22] Filed: Jan. 22, 1993

[30] Foreign Application Priority Data

Jan. 23, 1992 [JP] Japan ..... 4-32772

[51] Int. Cl.[5] ..... H01J 3/02

[52] U.S. Cl. ..... 250/423 R; 250/427; 315/111.81; 313/230; 313/362.1

[58] Field of Search ..... 250/423 R, 427; 315/111.81; 313/230, 362.1

[56] References Cited

U.S. PATENT DOCUMENTS

| | | | |
|---|---|---|---|
| 5,028,791 | 7/1991 | Koshiishi et al. | 250/427 |
| 5,049,784 | 9/1991 | Matsudo | 315/111.81 |
| 5,083,061 | 1/1992 | Koshiishi et al. | 315/111.81 |
| 5,089,747 | 2/1992 | Koshiishi et al. | 315/111.81 |
| 5,097,179 | 3/1992 | Takayama | 315/111.81 |
| 5,101,110 | 3/1992 | Matsudo et al. | 250/427 |

FOREIGN PATENT DOCUMENTS

| | | |
|---|---|---|
| 62-278736 | 12/1987 | Japan . |
| 3-112044 | 5/1991 | Japan . |

*Primary Examiner*—Jack I. Berman

*Attorney, Agent, or Firm*—Oblon, Spivak, McClelland, Maier & Neustadt

[57] ABSTRACT

An ion source device includes an electron generating chamber detachably combined with an electron attraction electrode and an ion generating chamber through insulating members. Hooks are projected from both sides of the electron generating chamber. A holder plate is arranged under the ion generating chamber with an insulating member interposed between them. A fixing member is arranged under the holder plate. The fixing member includes a pusher supported by coned disc springs and this pusher of the fixing member is fitted into a recess on the underside of the holder plate and struck against the top of the recess. A pair of holder members are arranged along both sides of the device. The holder members are detachably engaged with the hooks of the electron generating chamber at the upper portion thereof and also detachably engaged with the fixing member at the lower portion thereof. The components ranging from the electron generating chamber to the holder plate are held and fixed between the hooks of the electron generating chamber and the pusher of the fixing member through the holder members.

20 Claims, 6 Drawing Sheets

ION SOURCE DEVICE

BACKGROUND OF THE INVENTION

1. Field of the Invention

The present invention relates to an ion source device.

2. Description of the Related Art

An ion source device is used for the ion implantation apparatus which is intended to implant impurity ions into the semiconductor wafer. Most of the ion source devices are of such type that voltage is added between a filament in an ion source chamber and an anode electrode, that a predetermined gas introduced into the ion source chamber is made plasma, and that desired ions are extracted from the plasma and then used for some purposes. The ion source device of the Freeman type can be cited as an example.

An ion source device of the electron beam exciting type is disclosed in Published Unexamined Japanese Patent Application No. 62-278736. In the case of this device, voltage is applied between the filament and the anode electrode to generate first plasma from the predetermined gas. Electrons are then extracted from the first plasma and introduced into an ion generating chamber. The electrons are radiated to an ion generating gas, which has been introduced into the ion generating chamber, to thereby generate second plasma. Ions in the second plasma are then drawn out-side through a slit of the ion generating chamber.

The ion source device of this electron beam exciting type is advantageous in that high density ions are available although energy used is low.

Components by which the ion source device is made are worn away by the sputtering and etching with ions in plasma. In addition, particles scattered from these worn-away parts of the components adhere, as sub-products. To the components and they are thus deposited on the components. This makes it necessary to exchange these components with new ones or add periodic maintenances such as cleaning to them.

When a high corrosion-proof gas is used as raw gas, it becomes more remarkable that the components are worn away and that the sub-products are deposited on them. When the ion generating chamber is made of molybdenum and the raw gas used is $BF_3$ (boron trifluoride) in the case of the ion source device of the electrons beam exciting type, insulating matters such as molybdenum fluoride adhere to the surface of an ion attraction electrode. Films of these matters are thus formed on the electrode to thereby make it impossible to obtain predetermined attraction voltage. In addition, the electric field-face becomes not uniform to thereby make it impossible to obtain the capacity of the predetermined ion source to an extent intended.

Ions generated are passed through the slit of the ion generating chamber. Components around the slit are thus sputtered and etched by the ions and worn away. The ion generating chamber provided with this ion emitting slit must be periodically maintained or exchanged with a new one if necessary.

In order to exchange only those components, which have been severely worn away, with new ones during the maintaining process, it has been proposed that the ion source device is assembled by plural detachable components and that these components are fixed as a unit by connecting rods.

The ion source device made in this manner is heated to a temperature higher than 800° C. when ions are to be generated. It is therefore thermally and repeatedly expanded and contracted so that its components can be distorted and split not to generate predetermined and stable ions. In addition, screws for fixing the connecting rods are baked, thereby making it difficult to dismantle the components or breaking them.

SUMMARY OF THE INVENTION

The present invention is therefore intended to eliminate the above-mentioned drawbacks.

Accordingly, the object of the present invention is to provide an ion source device capable of generating more stable ions and being more easily maintained.

According to the present invention, there can be provided an ion source device comprising a casing having a slit through which ions are emitted; means for generating plasma, in which the ions are contained, in the casing; a first component for forming a part of the casing; a second component forming another part of the casing, said second component being formed independent of the first component and detachably combined with the first component; a pair of projections projected from both sides of the first component; a holder plate contacted with the second component, located in opposite to the first component and having a recess on its side opposed to the first component; a fixing member contacted with the holder plate and located in opposite to the second component, said fixing member including a fixing member body, a pusher fitted into the recess of the holder plated and struck against the top of the recess, and springs for elastically supporting the pusher in the fixing member body; and a pair of holder members arranged along both sides of the casing, each holder member being engaged with both of the first component and the fixing member through a first engaging means detachably engaged with the projection of the first component and through a second engaging means detachably engaged with the fixing member; wherein said first and second components and said holder plate are held and fixed between the projections of said first component and the pusher of said fixing member through the holder members.

According to an ion source device of the present invention arranged as described above, components by which the casing is made are detachably assembled and fixed as a unit by the elastic pusher of the fixing member and by the holder members. Even when the ion source device is repeatedly subjected to the thermal expansion and contraction, therefore, its distortion can be absorbed by the elastic pusher. Further, dismantling and assembling of the ion source device can be made easier and time needed to maintain the device can be shortened to a greater extent. Still further, it is made possible that only those components which have been worn away are exchanged with new ones.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
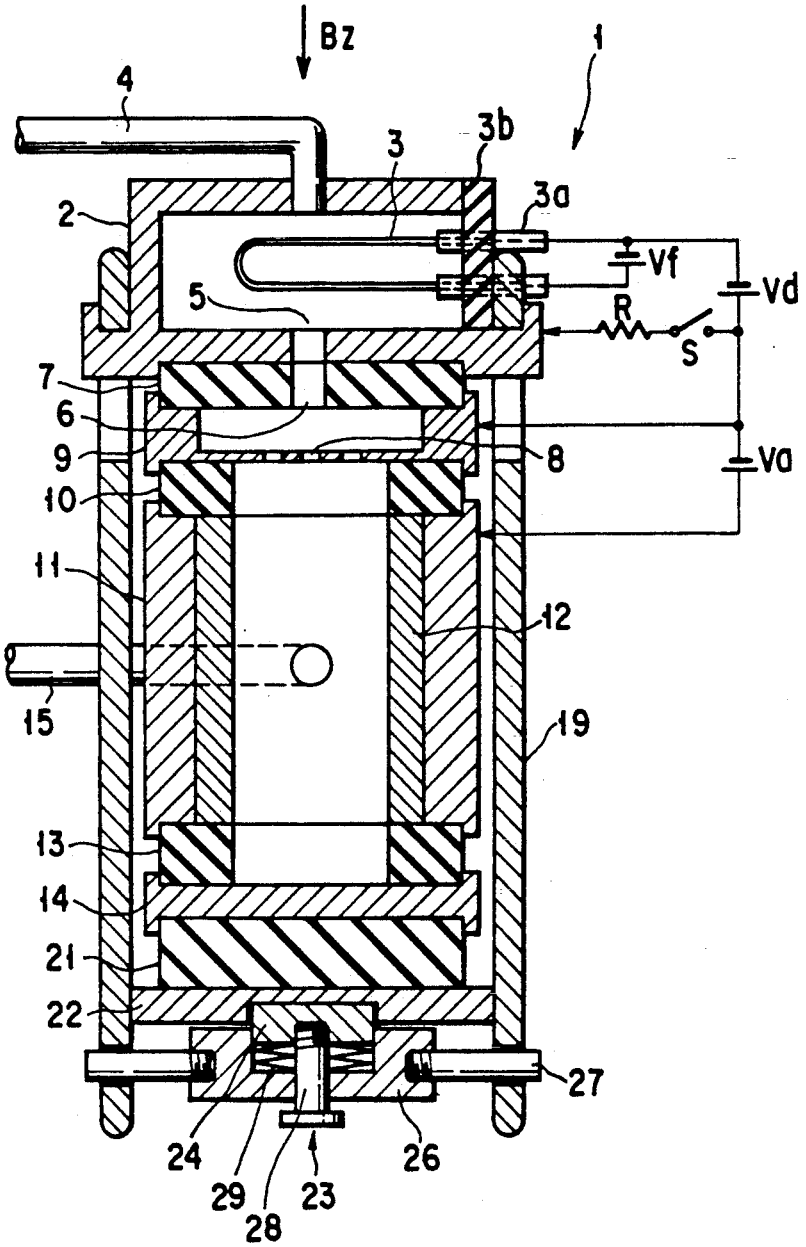
FIG. 1 is a vertically-sectioned view showing an ion source device according to a first embodiment of the present invention.
Figure 2:
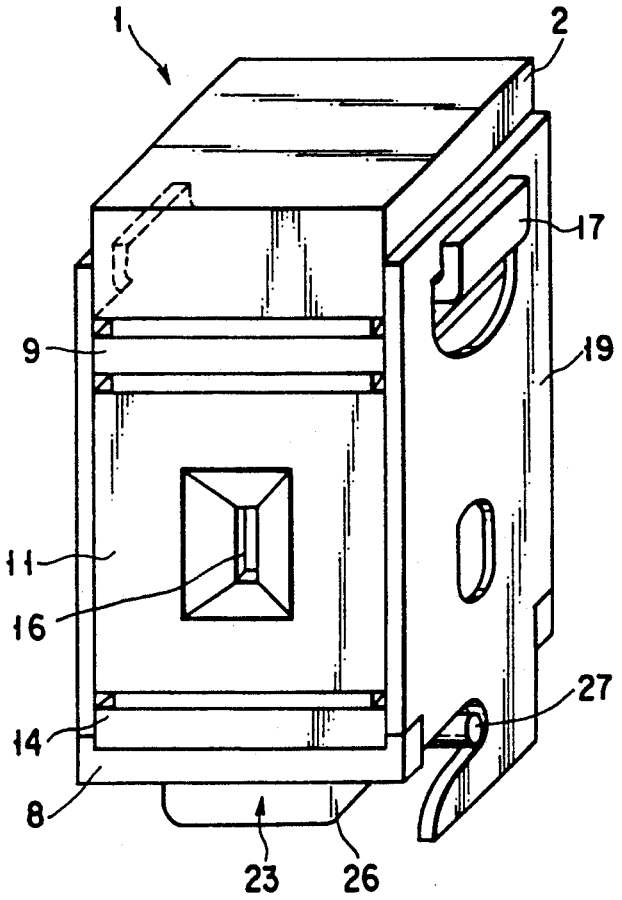
FIG. 2 is a perspective view showing the ion source device.

An ion source device 1 according to a first embodiment of the present invention shown in FIG. 1 has on its top an electron generating chamber 2 shaped like a rectangle and having each side of several centimeters. The electron generating chamber 2 is made of a conductive material, high in melting point, such as molybdenum or conductive ceramic, e.g. BN Composite EC (trade name; made by Electrochemical Industries Corporation). A U-shaped filament 3 made of tungsten is arranged in the electron generating chamber 2 and it is attached to connectors 3*a* which are made of conductive material such as tantalum. The connectors 3*d* are supported by a heat-proof insulating member 3*b* made of $Si_3N_4$ or BN, for example, are insulated from the electron generating chamber 2.

A pipe 4 is connected to the top of the electron generating chamber 2 and a gas for discharge such as argon is introduced into the electron generating chamber 2 through the pipe 4 to generate electrons by which plasma is induced.

A circular hole 5 is formed in the bottom of the electron generating chamber 2 and electrons in the plasma in the electron generating chamber 2 are extracted outside through the hole 5. An insulating member 7 made of ceramic is arranged under the electron generating chamber 2. The insulating member 7 is a rectangular plate having a hole 6 which is aligned with the hole 5 of the electron generating chamber 2. An electron attraction electrode 9 made of molybdenum and having plural apertures 8 is arranged under the insulating member 7.

An ion generating chamber 11 is arranged under the electron attraction electrode 9 with an insulating member 10 interposed between them. The insulating member 10 is a rectangular plate made of ceramic and having a circular opening at the center thereof. The ion generating chamber 11 is shaped like a rectangle and made of a conductive material, high in melting point, such as molybdenum. An inner cylinder 12 made of a conductive ceramic, for example, is arranged in the ion generating chamber 11, covering the inner metal faces of the chamber 11.

A bottom plate 14 made of AISI 310S is arranged under the ion generating chamber 11 with an insulating member 13 interposed between them. The insulating member 13 is a rectangular plate made of ceramic and having a circular opening at the center thereof.

A pipe 15 is connected to the rear side of the ion generating chamber 11 and a raw gas such as $BF_3$ is introduced into the ion generating chamber 11 through the pipe 15 to generate desired ions in the chamber 11. An ion releasing slit 16 is formed in that area of the front side of the ion generating chamber 11 which is in opposite to the pipe 15 of the rear side. An ion attraction electrode (not shown) is arranged in front of the slit 16 to draw ions outside the ion generating chamber 11 through the slit 16.

Filament voltage Vf is applied to the filament 3. Discharge voltage Vd is applied between one end of the filament 3 and the electron attraction electrode 9. A resistor R is connected between the electron attraction electrode 9 and the ion generating chamber 11 via a switch S. Accelerating voltage Va is applied between the electron attraction electrode 9 and the ion generating chamber 11. A magnetic field generator means (not shown) is arranged outside the ion source device 1 to generate magnetic field in a direction Bz in FIG. 1 so as to reduce the diffusing of electrons which are discharged into the ion generating chamber.

The above-mentioned conductive members 2, 9, 11 and 14 are insulated from their adjacent ones by the insulating members 7, 10 and 13, respectively. The conductive members 2, 9, 11 and 14 have recesses on either of or both of the top and bottom, and the insulating members 7, 10 and 13 are not bonded but fitted in these recesses between the adjacent conductive members.

Figure 3:
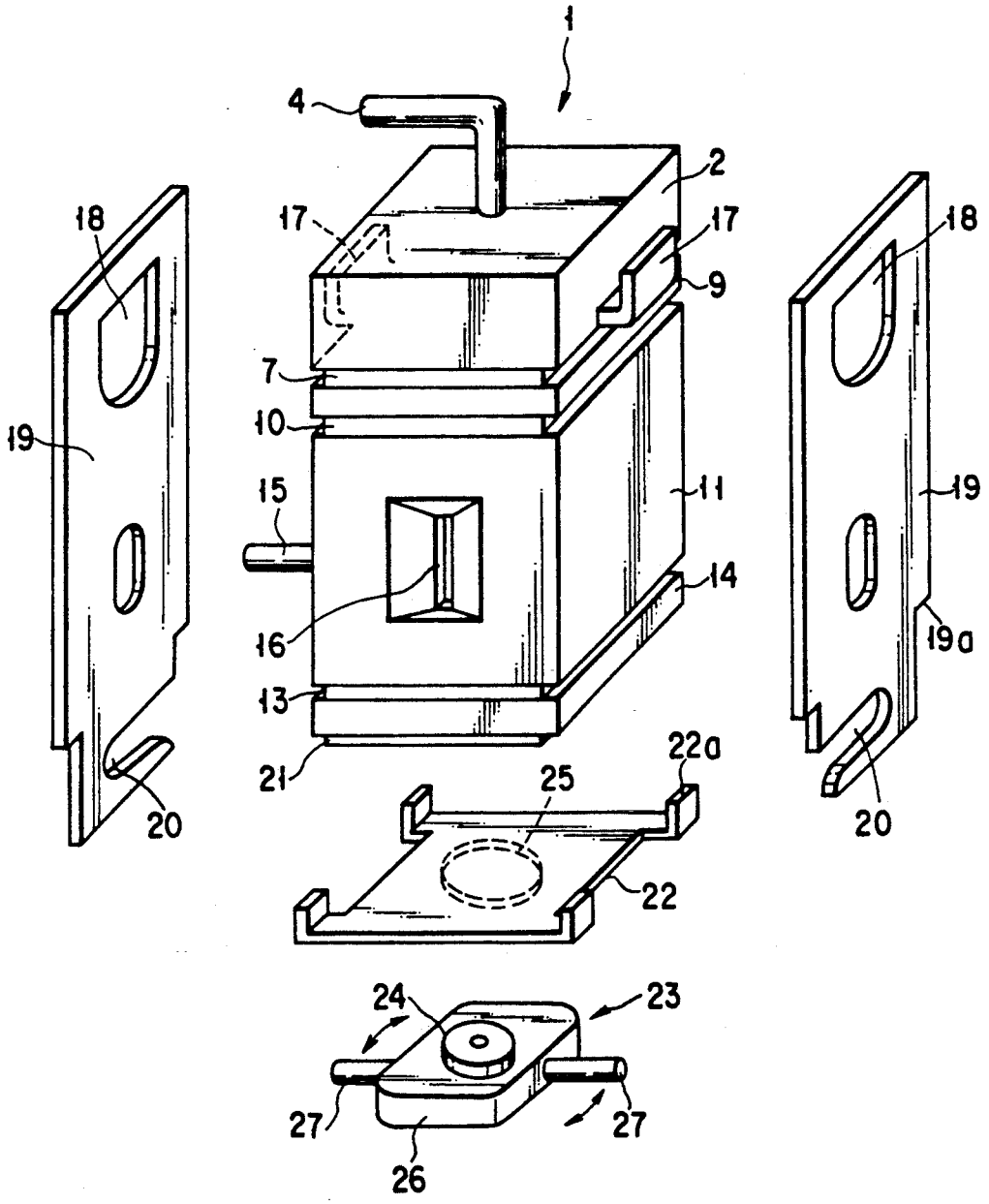
FIG. 3 is a perspective view showing the ion source device dismantled.

As shown in FIG. 3, two hooks 17 are projected, symmetrical to each other, from right and left sides of the electron generating chamber 2. Two holder members 19 each having a hole 18 at the upper end portion thereof are arranged on both sides of the electron generating chamber 2 and each of them is hung on the hook 17 through its hole 18. Further, it has a groove 20 at the lower end portion thereof and a fixing member (which will be described later) is fitted into the grooves 20 of the holder members 19.

A holder plate 22 is arranged under the bottom plate 14 with an insulating member 21 interposed between them. The insulating member 21 is fitted into recess on the underside of the bottom plate 14. Projections 22*a* which serve as rotation stoppers are formed at four corners of the holder plate 22 and a recess 25 is formed on the underside of the holder plate 22 at the center thereof.

Figure 4:
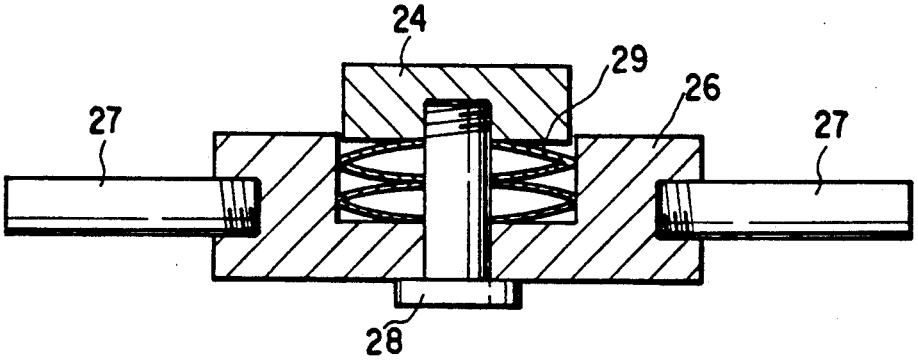
FIG. 4 is a vertically-sectioned view showing a fixing member used for the ion source device.

The fixing member 23 is arranged under the holder plate 22. It includes a body 26 having a recess 26*a* at the center thereof. A bolt 28 is loosely passed, from below, through the body 26 at the center thereof and projected into the recess 26*a* of the body 26. It is further screwed into a solid pusher 24, passing through coned disc springs 29 made of heat-proof Inconel. The pusher 24 is thus made elastic in the recess 26*a* by the springs 29. Rods 27 are screwed into both sides of the body 26, respectively, and they are engaged with the grooves 20 of the holder members 19 at their free ends. FIG. 4 shows the fixing member 23 detached from the ion source device 1 and FIG. 1 shows it attached to the device 1.

All of the holder members 19, holder plate 22, fixing member body 26, rods 27 and pusher 24 are made of AISI 310S. They may be made of one of other heat-proof materials. The coned disc springs 29 are made of Inconel X-750 (trade name). They may be made of other material such as ceramic if it is durable and can be elastic under a temperature of 1000° C. They may be replaced by other elastic members such as coil springs.

When the whole of the ion source device is to be assembled, as shown in FIG. 3, the conductive members 2, 9, 11 and 14 are piled in this order while interposing the insulating members 7, 10 and 13 between the members 2 and 9, between the members 9 and 11, and between the members 11 and 14. They are then mounted on the holder plate 22 with the insulating member 2 interposed between them. The holder members 19 are hung from the hooks 17 on both sides of the electron generating chamber 2. The open ends of the grooves 20 of the holder members 19 are directed this time in reverse directions, as shown in FIG. 3. Stepped portions 19*a* of the holder members 19 are engaged with projections 22*a* of the holder plate 22.

The fixing member 23 is then contacted with the underside of the holder plate 22 and its rods 27 are fitted into the grooves 20 of the holder members 19 while rotating it in the anticlockwise direction in FIG. 3. Its pusher 24 is thus positioned in the recess 25 of the holder plate 22. Because the bottom of the groove 20 of each holder member 19 is tapered, it serves as a cam face for guiding the rod 27. The fixing member is thus moved upwards as it is rotated. The pusher 24 is thus pushed against the top of the recess 25 of the holder plate 22.

When the pusher 24 is under such a state that it is positioned in the recess 25 of the holder plate 22, its top is struck against the top of the recess 25 by means of the coned disc springs 29. Therefore, the members 2, 7, 9, 10, 11, 13, 14 and 21 are fixed by the fixing member 23 while being held between the holder plates 19 hooked by the hooks 17 and on the holder plate 22. The assembling of the ion source device is thus finished.

The insulating members 7, 10, 13 and 21 are formed to have sides different in length from the others by 1 mm and this prevents them from being wrongly positioned upon assembling them.

Figure 8:
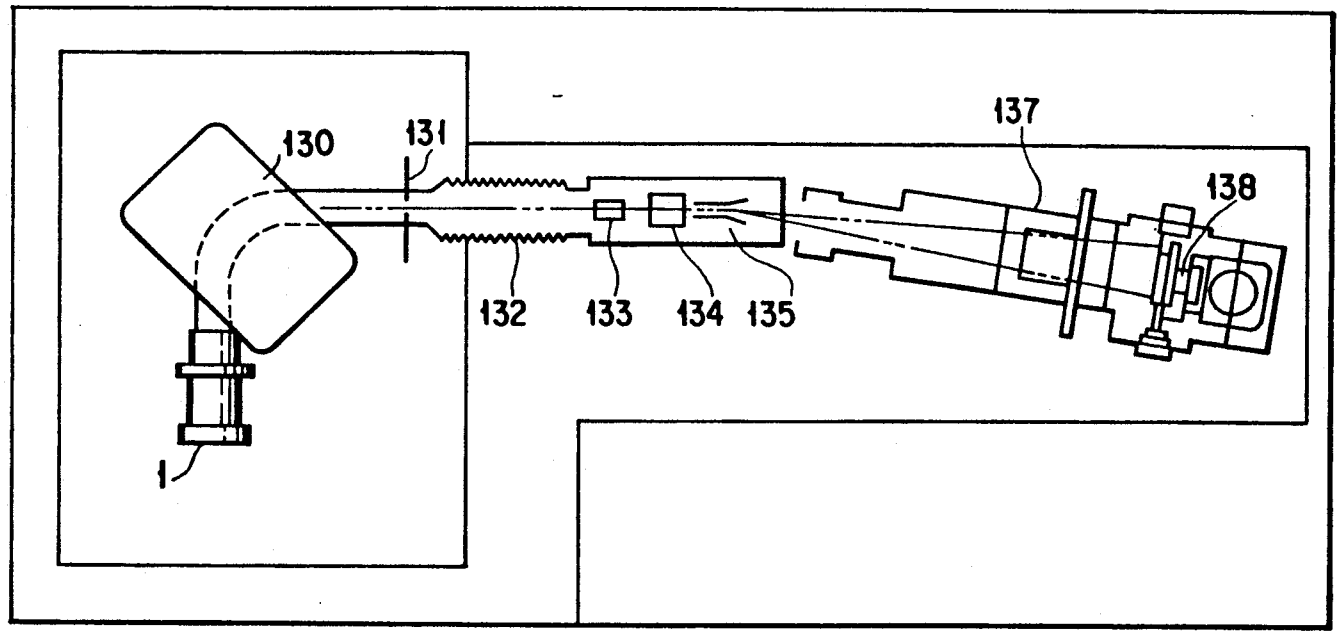
FIG. 8 is a plan showing an ion implantation apparatus.

The ion source device 1 is used, for example, with an ion implantation apparatus shown in FIG. 8. Impurity ions generated in the ion source device 1 pass, as an ion beam, through a magnet 130 which allows ions of a predetermined mass to pass through it. Impurity ions not needed are thus removed from the ions beam and the ions beam which includes impurity ions needed is then moved to a variable slit 131. The ions beam which has passed through the variable slit 131 is accelerated to a predetermined speed by an accelerating tube 132 and converged by an electronic lens 133. Its orbit is then determined by Y- and X-direction scanning electrodes 134 and 135 and it reaches a Faraday tube 137 which serves as an ion implantation section. A support 138 on which a semiconductor wafer is supported is located at one end of the Faraday tube 137 and when the ion beam comes into the semiconductor wafer, the ion implantation is realized.

It will be described how ions are generated in the ion source device 1.

A discharge gas such as argon gas is introduced into the electron generating chamber 2 at a predetermined flow rate of 0.05 SCCM or more through the pipe 4. At the same time, the filament 3 is heated by filament voltage Vf to generate thermions and discharge is caused by discharge voltage Vd to generate plasma.

Electrons in the plasma are passed through the holes 5, 6 and the plural apertures 8 of the electron attraction electrode 9 by accelerating voltage Va, constricted by magnetic field and drawn into the ion generating chamber 11.

On the other hand, a predetermined raw gas is introduced at a predetermined flow rate of 0.15 SCCM or more into the ion generating chamber 11 through the pipe 15. At the same time, exhaust is carried out through an exhaust opening (not shown) to keep the ion generating chamber 11 at a predetermined pressure or raw gas atmosphere of 0.02 Torr, for example.

Therefore, the electron which have flowed into the ion generating chamber 11 are accelerated by the accelerating electric field, constricted by the magnetic field and caused to collide against raw gas molecules to generate high density plasma.

Ions in the plasma are then extracted through the ions emitting slit 16 by the ion attraction electrode (not shown) and scan-radiated, as an ions beam, onto the semiconductor wafer, for example.

Those areas of the inner faces of the ion generating chamber 11 which are not covered by the inner cylinder 12 are worn away this time by actions (sputtering and etching, for example) of the plasma in the ion generating chamber 11. Further, particles thus worn way and scattered from the inner faces of the chamber 11 adhere to the component forming the slit 16 and its vicinity. This leads the device 1 to malfunction, thereby making it necessary to add periodic maintenances to the device 1.

When the device 1 is to be dismantled for the maintenance, the fixing member 23 is rotated in a direction (or clockwise direction in FIG. 3) reverse to the direction in which it was rotated upon assembling the device 1. Because the bottom face of the groove 20 of each holder member 19 is tapered to serve as a cam face for guiding the rod 27 of the fixing member 23 along it, the fixing force of the fixing member 23 added to the holder plate 22 is gradually reduced as the fixing member is rotated. When the rods 27 are finally released from the grooves 20, the pusher 24 can come out of the recess 25 of the holder plate 22 and the fixing member 23 can be thus detached from the device 1. This makes it possible to dismantle those members of the device 1 which are only fitted one another.

Figure 5:
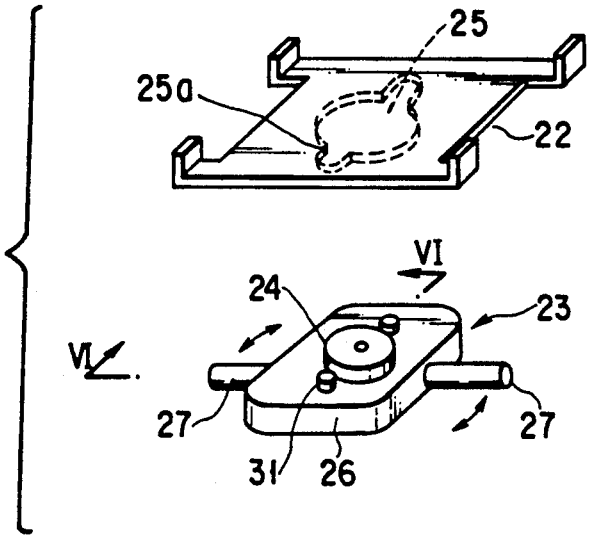
FIG. 5 is a perspective view showing a holder plate and a fixing member used for the ion source device according to a second embodiment of the present invention.
Figure 6:
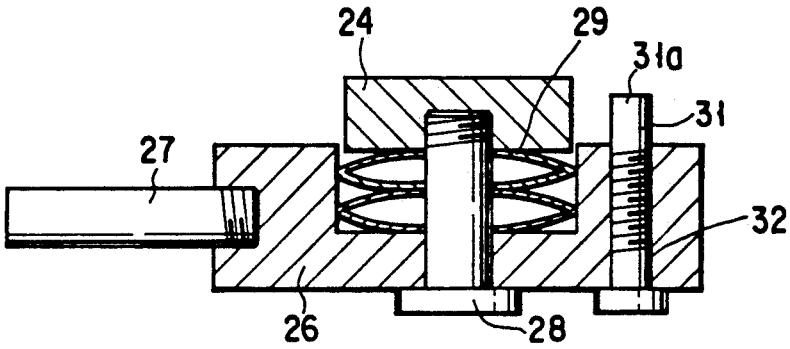
FIG. 6 is s sectional view taken along a line VI—VI in FIG. 5 to show the fixing member.

FIG. 5 is a perspective view showing a holder plate and a fixing member used with the ion source device according to a second embodiment of the present invention. FIG. 6 is a sectional view taken along a line VI—VI in FIG. 5. Members corresponding to those of the first embodiment shown in FIGS. 1 through 4 will be represented by the same reference numerals and description on these members will be omitted.

In the case of this second embodiment shown in FIGS. 5 and 6, the fixing member 23 is provided with a pair of detent screws 31. Each screw 31 is shifted from the rods 27 by 90 degrees. It is screwed into a screw hole 32 of the body 26 and when its head located below is manually rotated, it can be adjusted to stop at a position where its top 31*a* is projected from the body 26 and at another position where its top 31*a* is retreated into the body 26. The recess 25 of the holder plate 22 is provided with two additional recesses 25*a* which are opposed to each other to correspond to the screws 31.

When the device 1 is to be assembled, the screws 31 are previously retreated into the body 26. After the fixing member 23 is attached to the holder plate 22 as seen in the case of the first embodiment, heads of the screws 31 are rotated to project the tops 31*a* of the screws 31 from the body 26 and engage them with the additional recesses 25*a* of the holder plate 22. When assembled in this manner, the backlash of the fixing member 23 can be prevented and the device 1 can be more reliably fixed by the fixing member 23. In addition, the position of each screw 31 can be adjusted only by a hand without strongly screwing it into the screw hole 32. This can prevent the screws 31 from being seized in their corresponding parts of the body 26 as seen in the case of screws used for the device of the connecting rod type.

Figure 7:
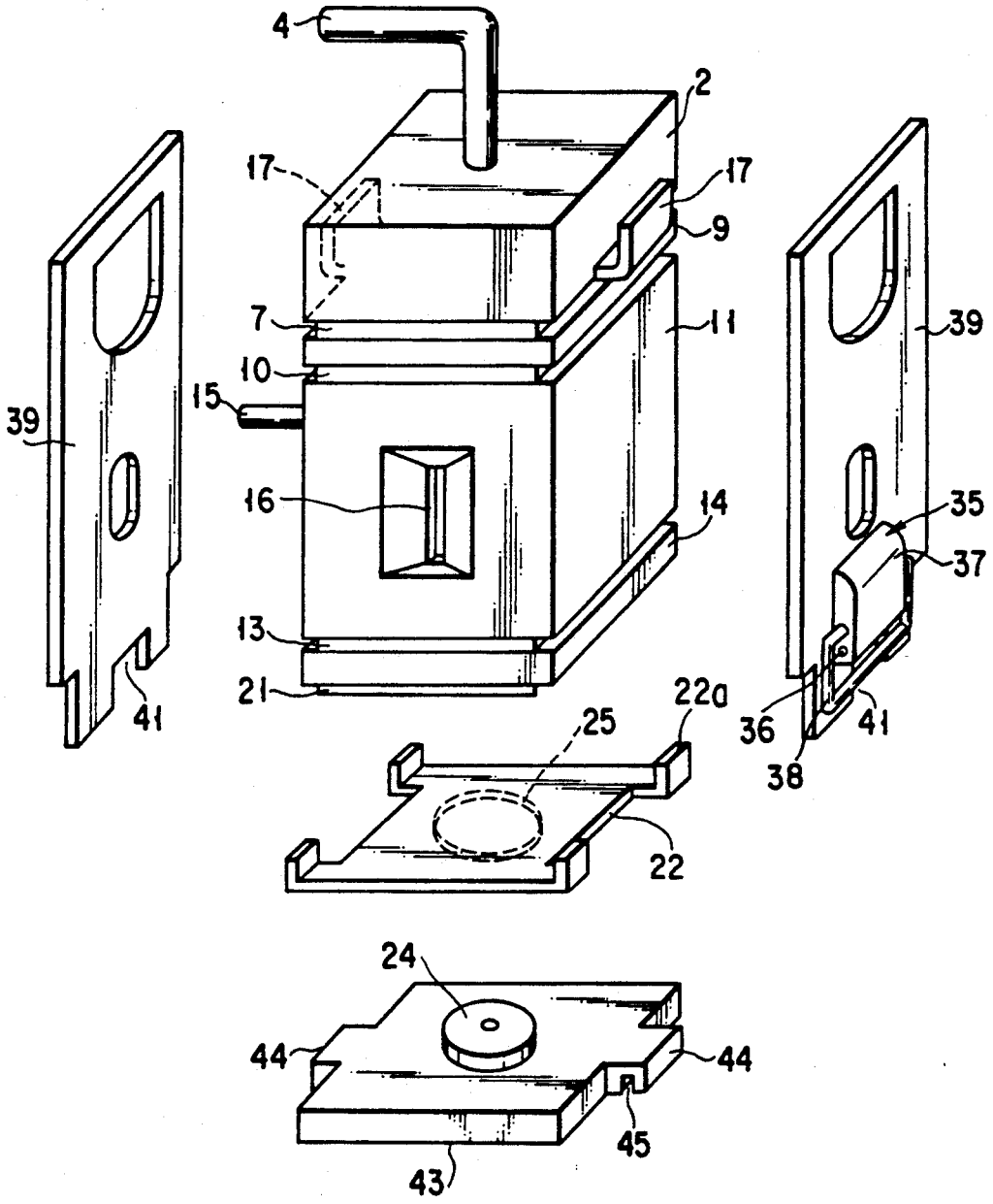
FIG. 7 is a perspective view showing the ion source device according to a third embodiment of the present invention dismantled.

FIG. 7 is a perspective view showing the ion source device according to a third embodiment of the present invention dismantled. Members corresponding to those of the first embodiment shown in FIGS. 1 through 4 will be denoted by the same reference numerals and description on these members will be omitted.

In the case of this third embodiment, clamps 35 are attached to both of holder members 39. Each clamp 35 includes a lever 37 swung round a shaft 36, and a ring 38 pivotally supported on the lever 37. Each ring 38 is positioned to face a rectangular recess 41 formed at the lower end portion of each holder member 39.

Hooks 44 are projected from both sides of a fixing member 43 and fitted into their corresponding recesses 41 of the holder members 39. A groove 45 which is directed downwards is formed on the underside of each hook 44. The rings 38 of the clamps 35 are engaged with their corresponding grooves 45 of the hooks 44.

When the device 1 is to be assembled, components ranging from the electron generating chamber 2 to the insulating member 21 are piled as described above, and they are mounted on the fixing member 43 with the holder plate 22 interposed between them. The pusher 24 of the fixing member 43 is fitted this time into the recess 25 of the holder plate 22. The holder members 39 are hung from the hooks 17 on both sides of the electron generating chamber 2 and the hooks 44 of the fixing member 43 are fitted into the recesses 41 of the holder members 39. The levers 37 of both clamps 35 are swung downwards to hook the rings 38 in the grooves 45 of both hooks 44. When the levers 37 are swung upwards and both clamps 35 are fastened, the pusher 24 is pushed against the top of the recess 25 of the holder plate 22. The device is thus assembled and fixed.

According to the above-described embodiments of the present invention, it is not needed that components are fixed by plural screws as seen in the conventional cases. This makes it possible to more uniformly add load to all of components when they are assembled. In addition, stress caused by the thermal expansion of components can be more uniformly added to all of components, thereby preventing the device from being distorted. Further, fixing and holding of the device or components are achieved by springs. Errors caused when components are made, and thermal deformations of components can be corrected accordingly. Still further, assembling and dismantling of the device can be made easier and time needed for the maintenance of the device can be shortened to a greater extent. Still further, components cannot be damaged by screws thermally seized because no fastening and fixing screw is used.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An ion source device comprising:

a casing having a slit through which ions are emitted;

means for generating plasma, in which the ions are contained, in the casing;

a first component for forming a part of the casing;

a second component forming another part of the casing, said second component being formed independent of the first component and detachably combined with the first component;

a pair of projections projected from both sides of the first component;

a holder plate contacted with the second component, located in opposite to the first component and having a recess on its side opposed to the first component;

a fixing member contacted with the holder plate and located in opposite to the second component, said fixing member including a fixing member body, a pusher fitted into the recess of the holder plate and struck against the top of the recess, and springs for elastically supporting the pusher in the fixing member body; and a pair of holder members arranged along both sides of the casing, each holder member being engaged with both of the first component and the fixing member through a first engaging means detachably engaged with the projection of the first component and through a second engaging means detachably engaged with the fixing member;

wherein said first and second components and said holder plate are held and fixed between the projections of said first component and the pusher of said fixing member through the holder members.

2. The ion source device according to claim 1, wherein said projections projected from both sides of said first component include hooks and the first engaging means of each holder member includes a stepped portion hung from its corresponding hook of said first component.

3. The ion source device according to claim 2, wherein said stepped portion of each holder member includes the upper rim of an opening formed in each holder member.

4. The ion source device according to claim 2, wherein said fixing member includes a pair of rods projected from both sides of said fixing member body and the second engaging means of each holder member includes a groove into which the rod of said fixing member body is inserted.

5. The ion source device according to claim 4, wherein said groove of each holder member has an open end on one side of said holder member, said holder members are positioned to direct the open ends of their grooves in reverse directions, and the rods of said fixing member body are inserted into the grooves of said holder members while rotating said fixing member.

6. The ion source device according to claim 5, wherein a part of the rim of the groove of each holder member serves as a cam face for guiding the rod of said fixing members, and as the rods of said fixing member are guided along the cam face of said holder member while rotating the fixing member, said fixing member body is moved toward said holder plate.

7. The ion source device according to claim 6, wherein said holder plate has an additional recess continuous from the above-mentioned recess thereof, said fixing member has a stopper engageable with the additional recess of said holder plate to stop its rotation, and the stopper of said fixing member can be projected from and retreated into the fixing member body to selectively engage the additional recess of said holder plate.

8. The ion source device according to claim 7, wherein the stopper of said fixing member includes a screw passed through the fixing member body.

9. The ion source device according to claim 4, wherein said holder plate includes projections contacted with sides of said holder members to stop its rotation.

10. The ion source device according to claim 2, wherein said fixing member includes a pair of hooks projected from both sides of said fixing member body, the second engaging means of each holder member includes a clamp engageable with its corresponding hook of said fixing member body to push the pusher of said fixing member against said holder plate, and said clamp of each holder member includes a ring hung on its corresponding hook of said fixing member body and a lever swung to move the ring.

11. An ion source device comprising:

an electron generating chamber;

an electron attraction electrode connected to the electron generating chamber through a first insulating member; electrode through a second insulating member;

a bottom plate connected to said side walls through a third insulating member, said side walls and said bottom plate being combined to substantially define an ion generating chamber, and said ion generating chamber being communicated with said electron generating chamber through apertures of said electron attraction electrode and having an opening in one of said side walls to emit ions;

means for generating plasma in the ion generating chamber, said plasma containing those ions to be emitted through the opening of said side wall;

a fourth insulating member contacted with the underside of said bottom plate, said first through fourth insulating members being detachably combined with their adjacent ones;

a pair of projections projected from both sides of said electron generating chamber;

a holder plate contacted with the underside of said fourth insulating member and having a recess on its underside;

a fixing member contacted with the underside of said holder plate and including a body, a pusher fitted into the recess of said holder plate and struck against the top of said recess, and springs for elastically supporting the pusher in the body; and a pair of holder members arranged along both sides of the device, each holder member being engaged with said electron generating chamber and said fixing member through a first engaging means detachably engaged with its corresponding projection of said electron generating chamber and through a second engaging means detachably engaged with said fixing member;

wherein said components ranging from the electron generating chamber to the holder plate are held and fixed between the projections of said electron generating chamber and the pusher of said fixing member through said holder members.

12. The ion source device according to claim 11, wherein said projections projected from both sides of said electron generating chamber include hooks and said first engaging means of each holder member includes stepped portion to hung said holder member from the hook of said electron generating chamber.

13. The ion source device according to claim 12, wherein the stepped portion of each holder member includes the upper rim of an opening formed in said holder member.

14. The ion source device according to claim 12, wherein said fixing member includes a pair of rods projected from both sides of said fixing member body and said second engaging means of each holder member includes a groove into which the rod of said fixing member body is inserted.

15. The ion source device according to claim 14, wherein said groove of each holder member has an open end on a side of the holder member, said holder members are positioned to direct the open ends of their grooves in reverse directions, and the rods of said fixing member body are inserted into the grooves of said holder members while rotating said fixing member.

16. The ion source device according to claim 15, wherein a part of the rim of said groove of each holder member serves as a cam face for guiding the rod along it, and as the rods of said fixing member body are guided into the grooves of said holder members along the cam faces of said grooves while rotating said fixing member, said fixing member body is moved toward said holder plate.

17. The ion source device according to claim 16, wherein said holder plate includes an additional recess continuous from the above-mentioned recess thereof, said fixing member includes a stopper engageable with the additional recess of said holder plate to stop its rotation, and said stopper can be projected from and retreated into said fixing member body to selectively engage the additional recess of said holder plate.

18. The ion source device according to claim 17, wherein said stopper includes a screw passed through the fixing member body.

19. The ion source device according to claim 14, wherein said holder plate includes projections engageable with sides of said holder members to stop its rotation.

20. The ion source device according to claim 12, wherein said fixing member includes a pair of hooks projected from both sides of said fixing member body, said second engaging means of each holder member includes a clamp engageable with the hook of said fixing member body to strike the pusher of said fixing member against said holder plate, and said clamp of each holder member includes a ring hung on its corresponding hook of said fixing member body and a lever swung to move the ring.

* * * * *